US011457784B2

(12) United States Patent
Liu et al.

(10) Patent No.: US 11,457,784 B2
(45) Date of Patent: Oct. 4, 2022

(54) VACUUM CLEANER WITH DUST BAG

(71) Applicant: Skybest Electric Appliance (Suzhou) Co., Ltd., Suzhou (CN)

(72) Inventors: Haiping Liu, Suzhou (CN); Feng Wang, Suzhou (CN); Yimin Han, Suzhou (CN); Bin Hu, Suzhou (CN)

(73) Assignee: SKYBEST ELECTRIC APPLIANCE (SUZHOU) CO., LTD., Suzhou (CN)

( * ) Notice: Subject to any disclaimer, the term of this patent is extended or adjusted under 35 U.S.C. 154(b) by 357 days.

(21) Appl. No.: 15/931,938

(22) Filed: May 14, 2020

(65) Prior Publication Data

US 2021/0121030 A1 Apr. 29, 2021

(30) Foreign Application Priority Data

Oct. 25, 2019 (CN) ..... 201921813362
Nov. 19, 2019 (CN) ..... 201921998491

(51) Int. Cl.

| | |
|---|---|
| ***A47L 9/14*** | (2006.01) |
| ***A47L 5/28*** | (2006.01) |
| ***A47L 9/00*** | (2006.01) |
| ***A47L 9/32*** | (2006.01) |

(52) U.S. Cl.

CPC ..... *A47L 9/1436* (2013.01); *A47L 9/1481* (2013.01); *A47L 5/28* (2013.01); *A47L 9/009* (2013.01); *A47L 9/325* (2013.01)

(58) Field of Classification Search

CPC ..... A47L 9/1436; A47L 9/1481; A47L 9/009; A47L 9/325; A47L 5/28

See application file for complete search history.

(56) References Cited

U.S. PATENT DOCUMENTS 6,217,641 B1 * 4/2001 Gunnarsson ..... A47L 9/2805 96/404
7,310,854 B2 12/2007 Nam et al.

* cited by examiner

*Primary Examiner* — Andrew A Horton
(74) *Attorney, Agent, or Firm* — JK Intellectual Property Law, PA

(57) ABSTRACT

A dust collector with a dust collecting bag includes a housing defining a dust collecting chamber; a bracket in the dust collecting chamber; an operating member connectable with the bracket; the dust collecting bag being mounted to a supporting plate; and the bracket being rotatable around a rotating member from a first position to a second position. The housing further includes a connecting member, and the operating member includes a first state and a second state. When the operating member is in the first state, the bracket is located at the first position, and the supporting plate mounted on the bracket is connected with the connecting member. When the operating member is in the second state, the bracket drives the supporting plate to move towards the second position so that the supporting plate is separated from the connecting member, and the supporting plate is separated from the bracket.

10 Claims, 9 Drawing Sheets

VACUUM CLEANER WITH DUST BAG

CROSS-REFERENCE TO RELATED PATENT APPLICATIONS

This application claims priority to CN Patent Application No. 201921998491.8, filed on Nov. 19, 2019 and CN Patent Application No. 201921813362.7, filed on Oct. 25, 2019. All of the aforementioned applications are hereby incorporated by reference in their entireties.

TECHNICAL FIELD

The present disclosure relates to the technical field of cleaning apparatus, especially relates to a dust collector a with dust collecting bag.

BACKGROUND

In order to facilitate cleaning by users, a part of the existing dust collector (also known as a vacuum cleaner) is provided with a dust collecting bag, and dust is collected through the dust collecting bag. When the dust collecting bag is full, the user only needs to remove the dust collecting bag from the dust collector and replace it with a new dust collecting bag, and then the cleaning operation can be continued. Thus, on the one hand, the user can carry out the cleaning operation more quickly, on the other hand, the user does not need to clean the dust collector frequently, thereby saving time.

The dust collecting bag of the existing dust collector is mainly taken down by the following method: first, a user directly contacts the dust collecting bag with hands to take the dust collecting bag down from the mounting device; second, the dust collector is provided with a button and a buckle structure which is matched with the button, and the buckle structure is matched with the dust collecting bag at the same time, thus the user can press the button to realize the separation of the dust collecting bag and the buckle structure, so that the dust collecting bag can be quickly replaced.

However, the above method of taking down the dust collecting bag has the following problems: first, after the dust collector has been working for a period of time, a large amount of dust is adsorbed on the surface of the dust collecting bag, and when a user directly takes down the dust collecting bag, the dust will inevitably adhere to the body of the user, so that the user experience is influenced; second, in order to achieve the stable mounting of the dust collecting bag, most of the existing dust collectors are equipped with at least two buckle structure, and the dust collecting bag is prevented from accidently falling off through clamping the dust collecting bag simultaneously by the at least two buckle structures. Thus, on the one hand, the overall structure of dust collector is more complicated, on the other hand, the dust collecting bag can't be separated from the buckle structure after the dust collecting bag is full of dust, so that the user can't make the dust collecting bag separate from the dust collector by pressing the button, influencing the user experience.

SUMMARY

The technical problem to be solved by the present disclosure is to provide a dust collector which can quickly take down the dust collecting bag by a user without contacting the dust collecting bag.

In order to solve the technical problem, the technical solution adopted by the present disclosure is a dust collector provided with a dust collecting bag, comprising: a housing which defines a dust collecting chamber; a bracket which is accommodated in the dust collecting chamber; an operating member which can be connected with the bracket; a supporting plate to which the dust collecting bag is mounted; a rotating member, around which the bracket can rotate from a first position to a second position; the housing further comprises a connecting member, and the operating member comprises a first state and a second state; when the operating member is in the first state, the bracket is located at the first position, and the supporting plate mounted on the bracket is connected with the connecting member; and when the operating member is in the second state, the bracket drives the supporting plate to move towards the second position together, so that the supporting plate is separated from the connecting member, and the supporting plate is separated from the bracket.

Furthermore, the rotating member includes a first shaft body and a second shaft body, the bracket is disposed between the first shaft body and the second shaft body, and the bracket is connected to the first shaft body and the second shaft body, respectively.

Furthermore, the dust collector further comprises at least one elastic member, the at least one elastic member is arranged between the rotating member and the bracket, one end of the elastic member is connected with the housing, and the other end of the elastic member is connected with the bracket.

Furthermore, the bracket further comprises a limiting portion, and the supporting plate is matched with the limiting portion to be detachably mounted on the bracket.

Furthermore, the limiting portion further comprises a sliding slot, and the supporting plate can move along the sliding slot.

Further, the supporting plate comprises an opening portion, and when the supporting plate moves to a first preset position along the sliding slot and the bracket is located at the first position, the opening portion is connected with the connecting member.

Furthermore, the connecting member is fixedly arranged in the dust collecting chamber and comprises a protruding portion, and when the operating member is in the second state, the bracket drives the supporting plate to move towards the second position together, so that the opening portion is separated from the protruding portion, and the supporting plate moves along the sliding slot due to gravity and is separated from the bracket.

Furthermore, the bracket further comprises a clamping portion, the operating member further comprises an adapting portion, the clamping portion is connected with the adapting portion through a buckle when the operating member is in the first state, and the clamping portion is separated from the adapting portion when the operating member is in the second state.

Furthermore, the clamping portion comprises a hook portion, the adapting portion comprises a clamping slot, and when the operating member is in the first state, the hook portion is clamped in the clamping slot.

In order to solve the technical problem, another technical solution adopted by the present disclosure is a dust collector provided with a dust collecting bag, comprising: a base; a floor brush assembly which is provided below the base and is connected with the base; a dust collecting device which is detachably mounted on the base and comprises a first working state and a second working state, when the dust collecting device is in the first working state, the dust collecting device is mounted on the base, and the floor brush assembly and the dust collecting device work together; when the dust collecting device is in the second working state, the dust collecting device is separated from the base; and the dust collecting device comprises an operating member by which the dust collecting bag can be separated from the dust collecting device.

For the dust collector of the present disclosure, after the supporting plate is mounted on the bracket, the bracket is pushed to move to the first position, and at this moment, the operating member is in the first state, the operating member is connected with the bracket, and the supporting plate is connected with the connecting portion in the housing; the bracket can rotate between the first position and the second position around the rotating member provided in the housing, and the user can apply an external force to the operating member to make the operating member be in the second state, and at this moment, the bracket is separated from the operating member, the bracket and the supporting plate move to the second position together, so that the supporting plate is separated from the connecting member, and the supporting plate is separated from the bracket due to gravity. The user only needs to operate the operating member, so that the dust collecting bag mounted on the supporting plate can be separated from the dust collector together with the supporting plate without directly contacting the dust collecting bag.

DETAILED DESCRIPTION

The present disclosure will be described in detail below with reference to specific embodiments shown in the accompanying drawings. However, these embodiments do not limit the present disclosure, and structural, method, or functional changes that can be made by those skilled in the art according to these embodiments are all included in the scope of the present disclosure.

It is to be understood that in the description of the embodiments of the present disclosure, the terms "first", "second", and the like are used for descriptive purposes only and are not to be construed as indicating or implying relative importance or implying the number of indicated technical features. Thus, a feature defined as "first" or "second" may explicitly or implicitly include one or more of that feature.

In the embodiments of the present disclosure, unless otherwise explicitly stated or limited, the terms "connected" and "connecting" are to be interpreted broadly, and may be, for example, a fixed connection, a movable connection, a detachable connection, or an integration; can be directly connected or indirectly connected through an intermediate medium; and can be internal connection between two elements or an interactive relationship between two elements. The specific meaning of the above terms in the present disclosure can be understood according to specific situations by those of ordinary skill in the art.

In particular embodiments of the disclosure, unless expressly stated or limited otherwise, the first feature "on" or "under" the second feature may comprise direct contact of the first and second features, or may comprise no direct contact of the first and second features but contact through additional features present therebetween.

In particular embodiments of the present disclosure, unless expressly specified or limited otherwise, the term "plurality" means two or more.

The dust collector with the dust collecting bag can be a hand-held dust collector, a barrel type dust collector, a vertical dust collector or other cleaning devices using the dust collecting bag. In the present embodiment, a vertical dust collector is taken as an example.

Figure 1:
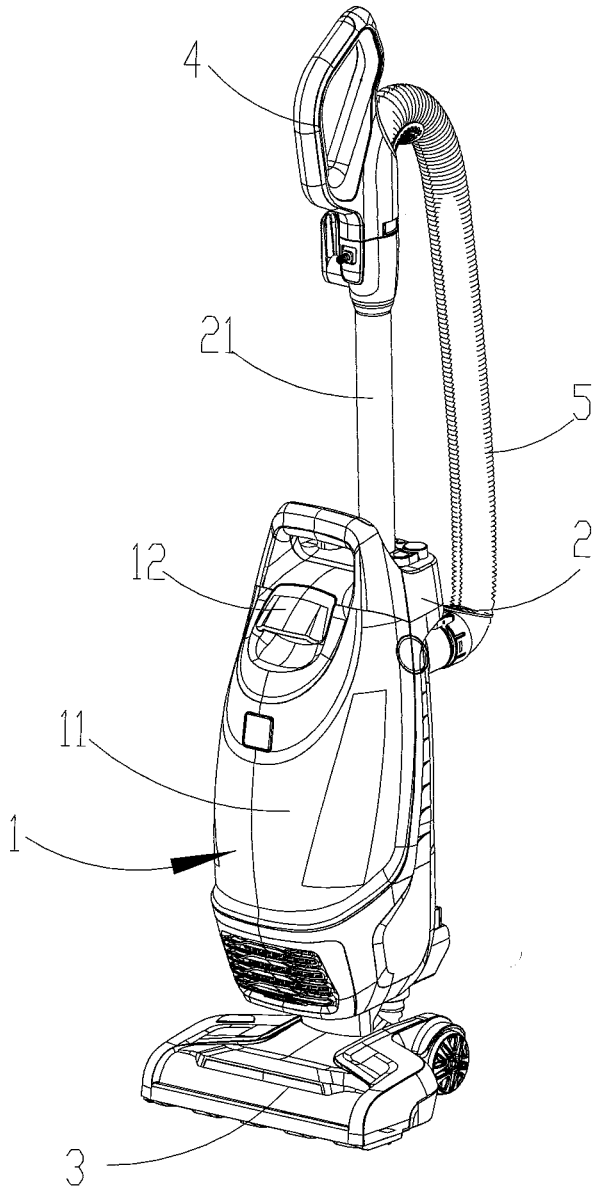
FIG. 1 is a schematic isometric view of a whole dust collector according to a preferred embodiment of the present disclosure.
Figure 2:
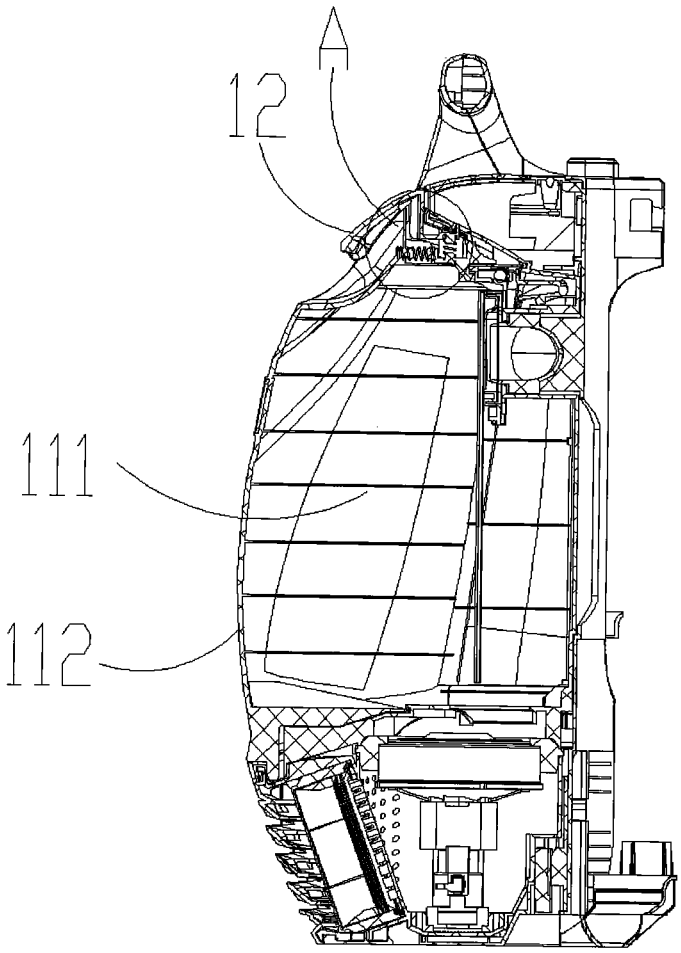
FIG. 2 is a cross-sectional view of a dust collecting device according to the preferred embodiment of the present disclosure.
Figure 3:
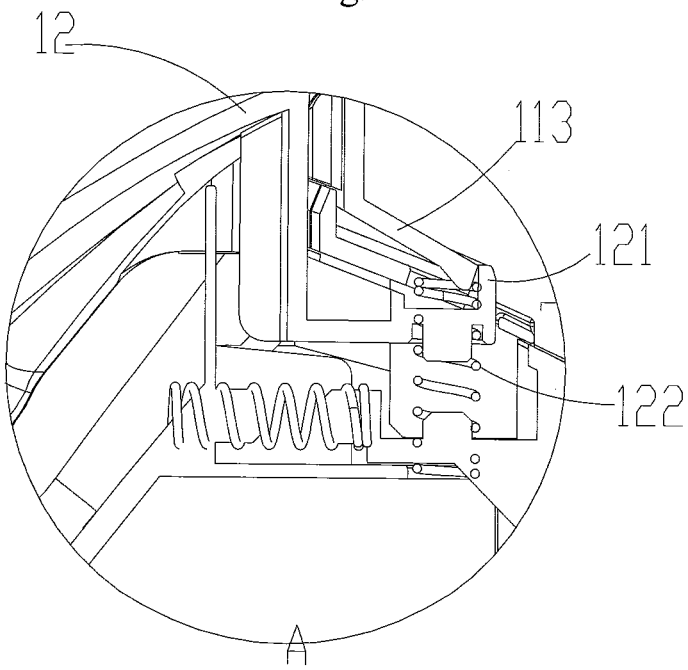
FIG. 3 is a partial enlarged view of portion A of FIG. 2.
Figure 4:
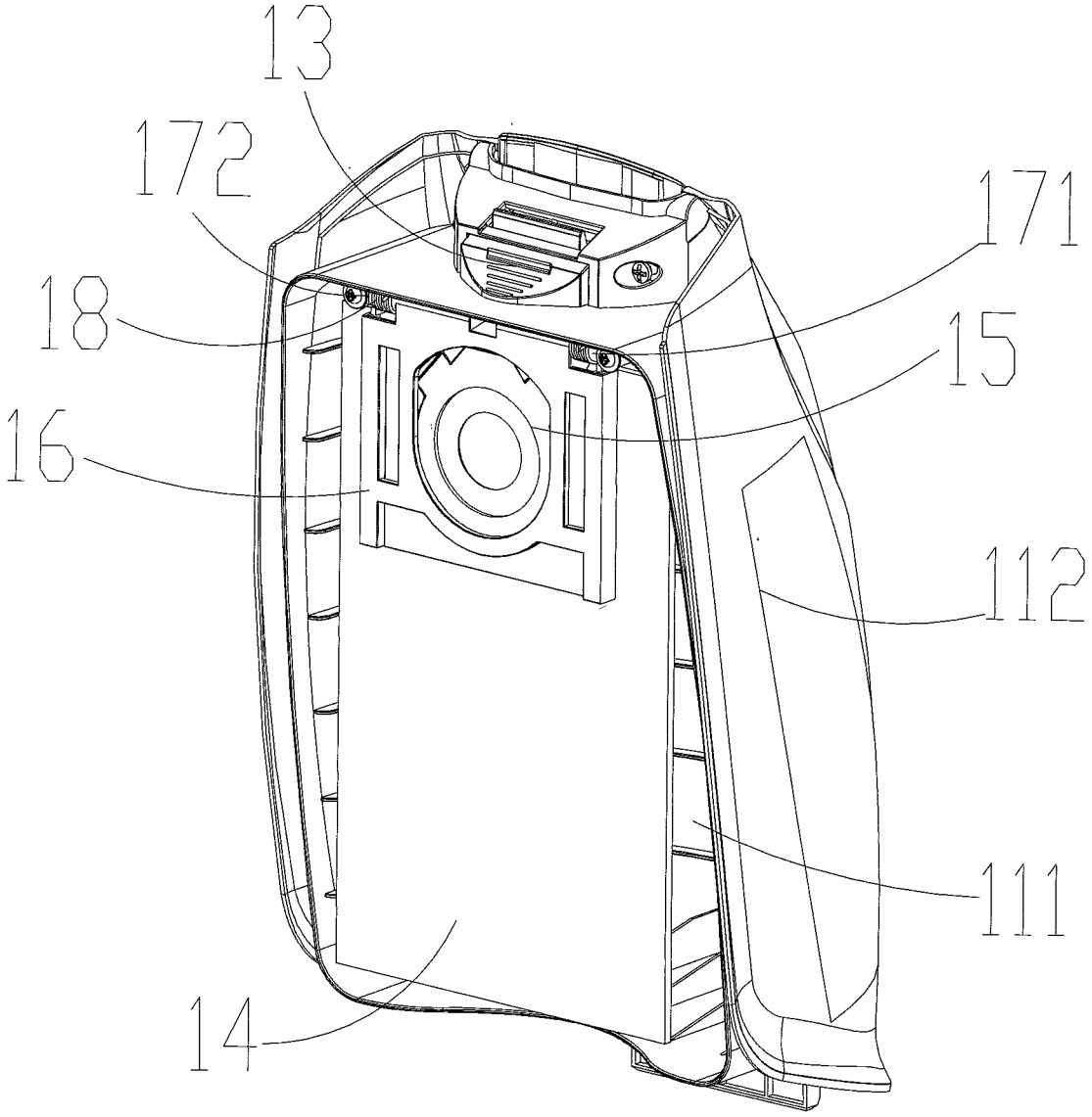
FIG. 4 is a schematic isometric view illustrating the dust cover of the dust collecting apparatus according to the preferred embodiment of the present disclosure.
Figure 5:
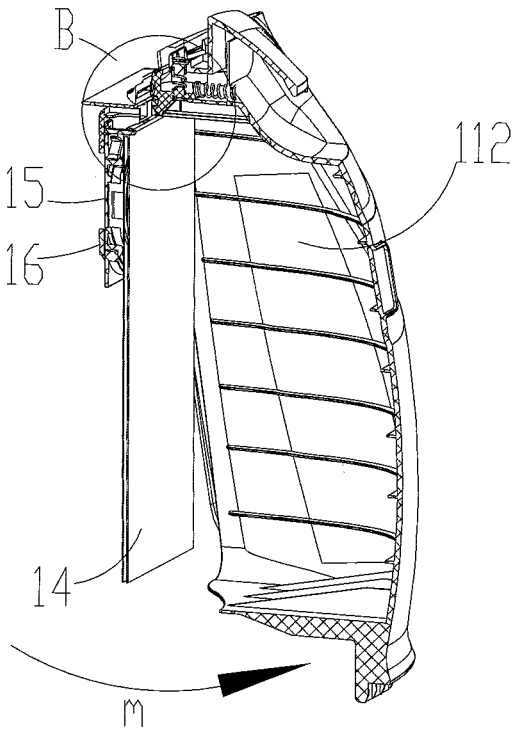
FIG. 5 is a cross-sectional view of the dust cover, with the operating member in a first state, of the preferred embodiment of the present disclosure.
Figure 6:
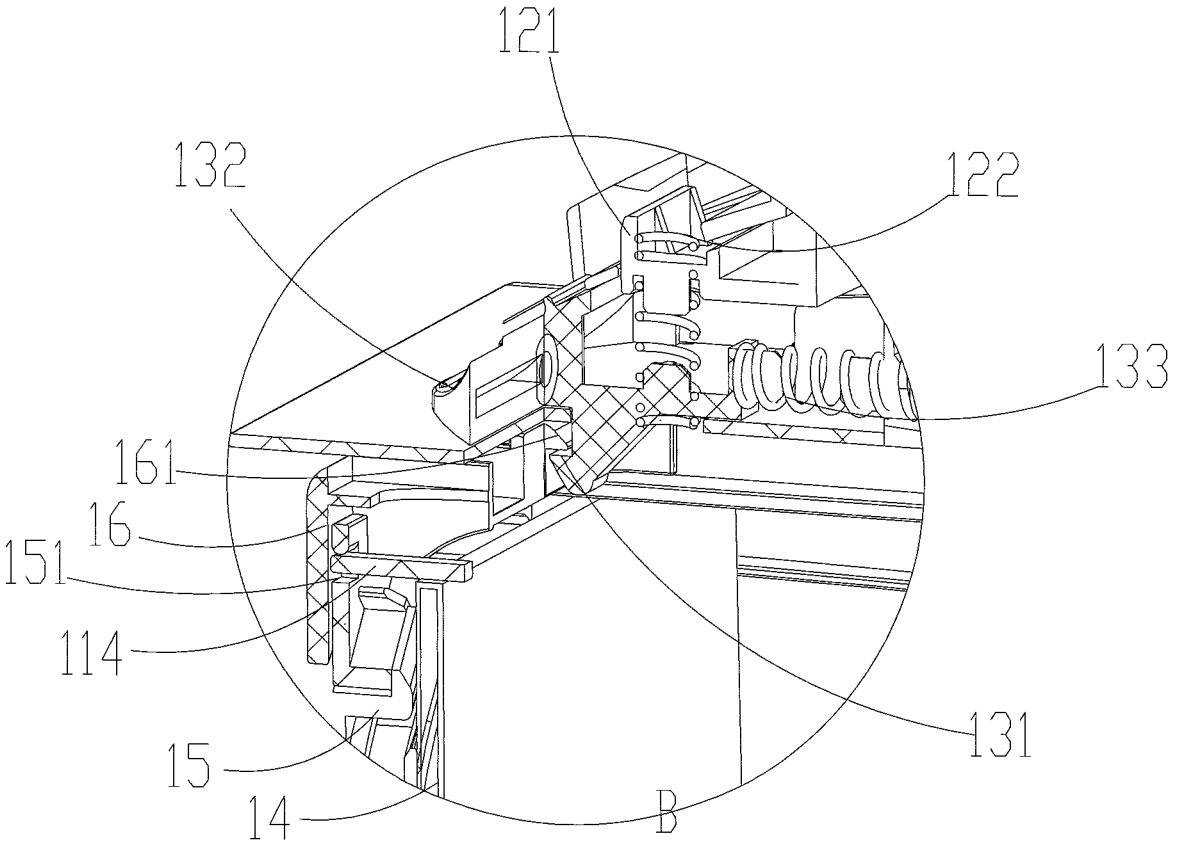
FIG. 6 is a partial enlarged view of portion B of FIG. 5.
Figure 7:
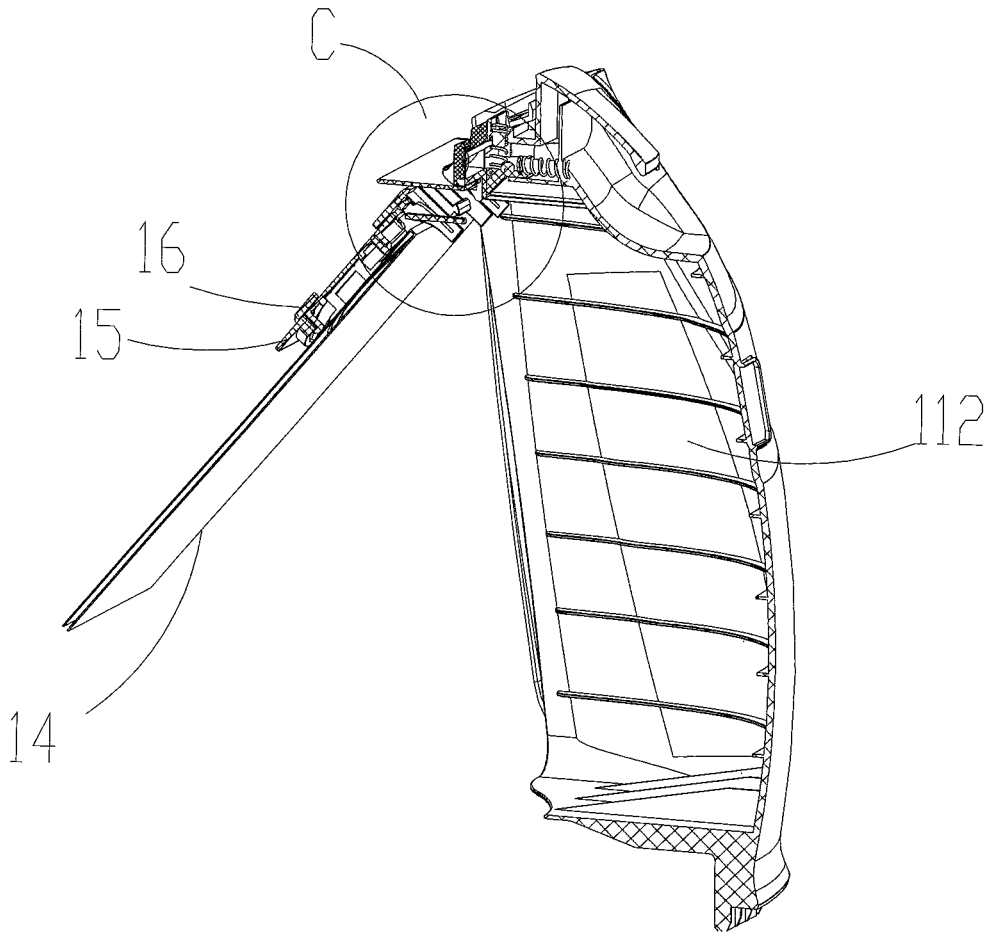
FIG. 7 is a first side cross-sectional view of the dust cover, with the operating member in a second state, of the preferred embodiment of the present disclosure.
Figure 8:
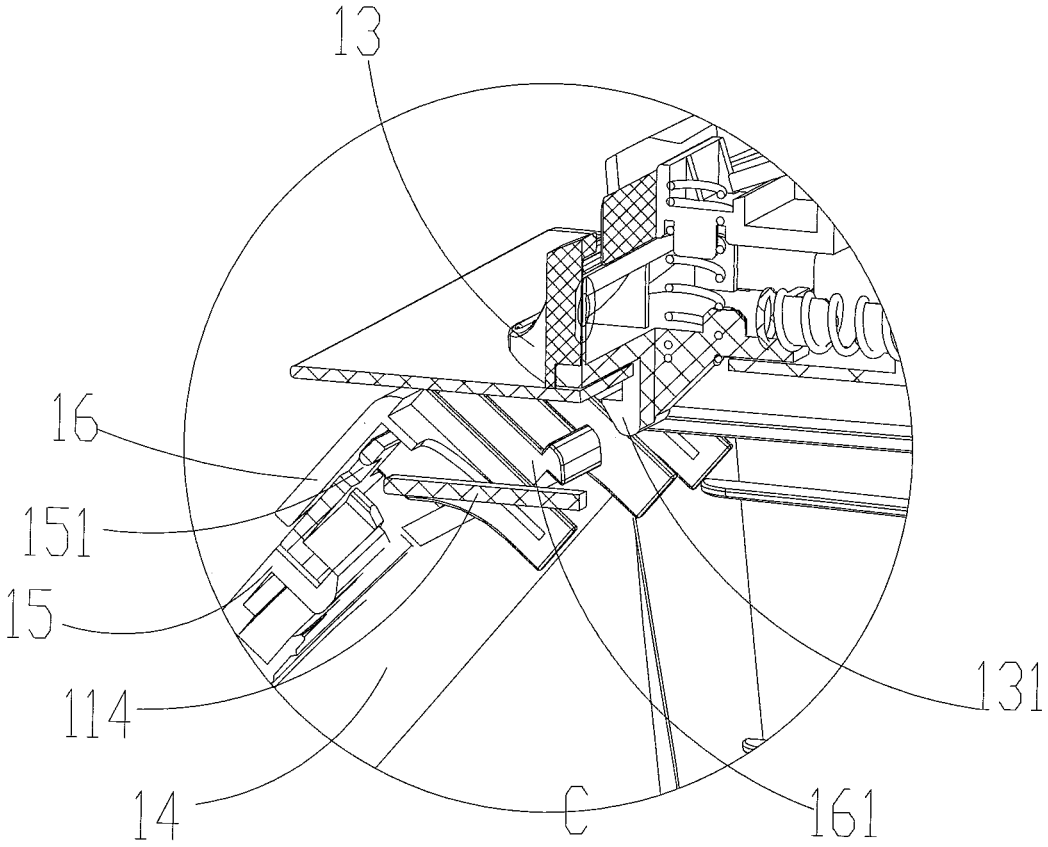
FIG. 8 is a partial enlarged view of portion C of FIG. 7.
Figure 9:
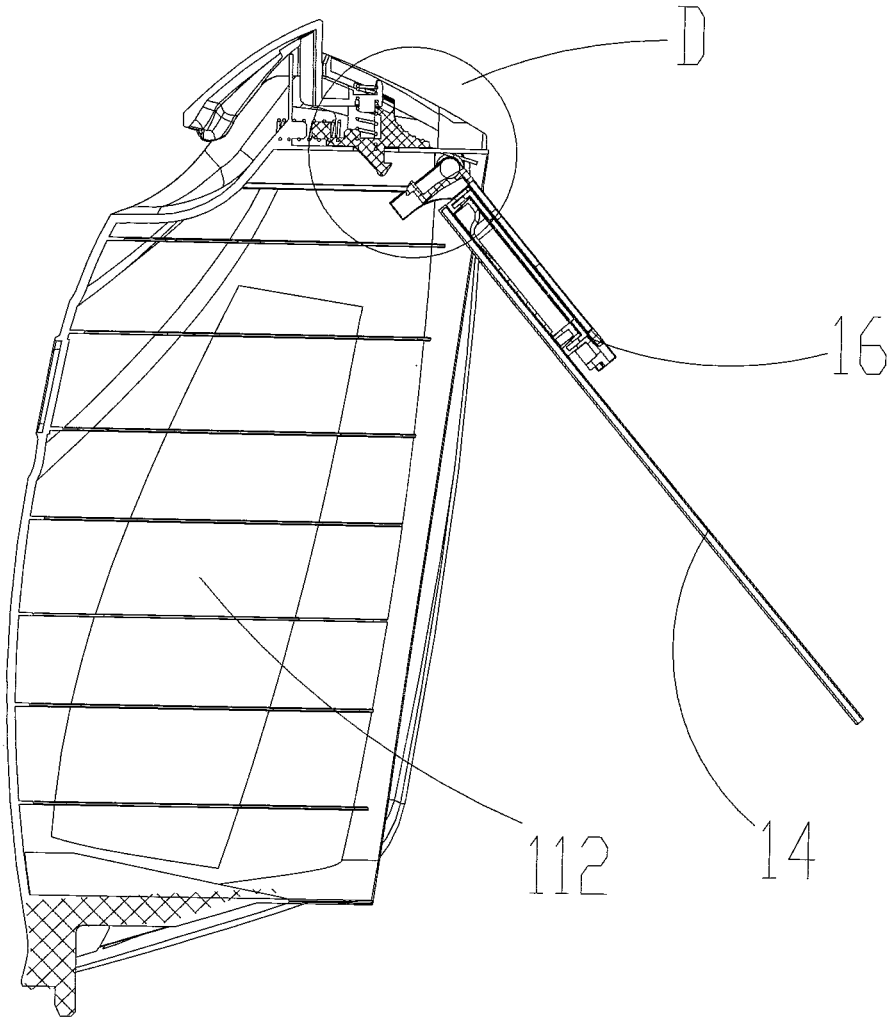
FIG. 9 is a second side cross-sectional view of the dust cover, with the operating member in a second state, of the preferred embodiment of the present disclosure.
Figure 10:
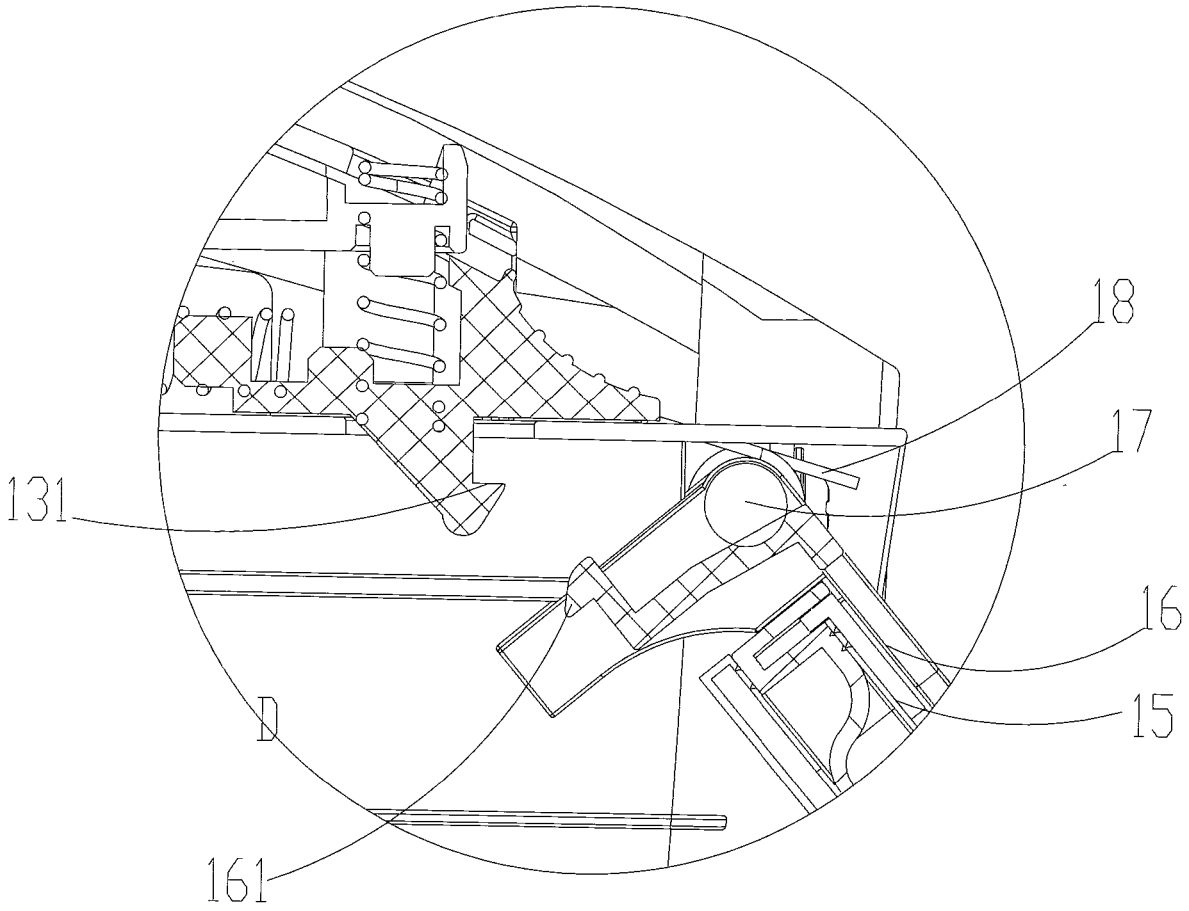
FIG. 10 is a partial enlarged view of portion D of FIG. 9.
Figure 11:
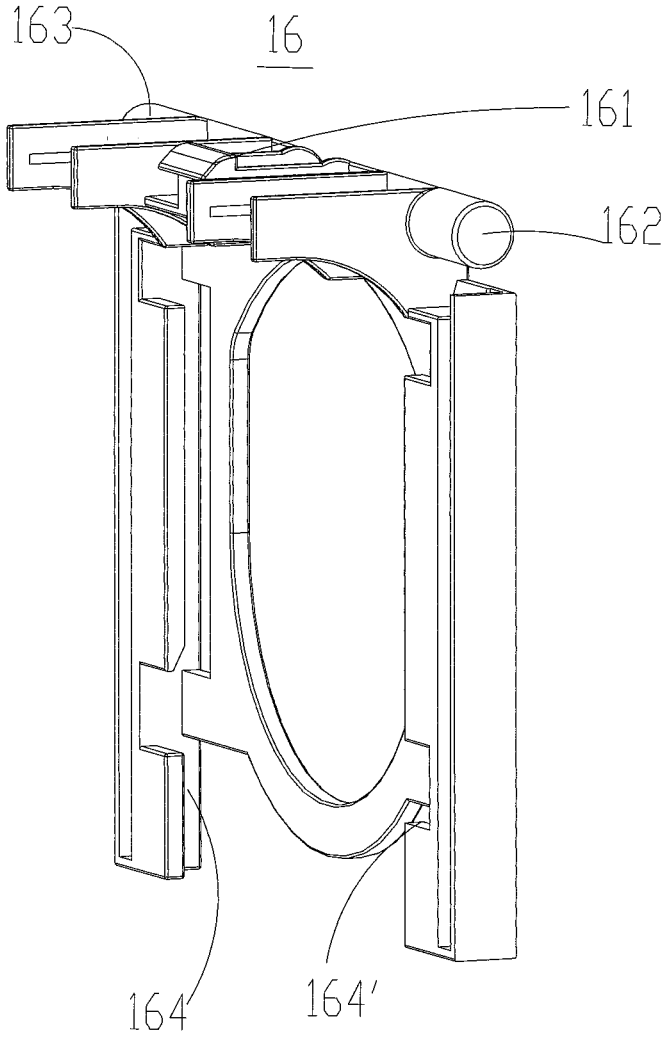
FIG. 11 is a schematic isometric view of the holder of the dust collecting device according to the preferred embodiment of the present disclosure.

Referring to FIGS. 1-11, the dust collector comprises a dust collecting device 1, a base 2, a floor brush assembly 3, a handle 4 and a hose 5. The dust collecting device 1 is detachably mounted on the base 2, thus, on the one hand, the user can comprehensively clean the home ground through the floor brush assembly 3, with high cleaning efficiency, and on the other hand, if the user only needs to clean a small area or an area not suitable for the work of the floor brush assembly 3, the user can detach the collecting device 1 and hold the collecting device 1 by hand for cleaning operation, so that the user can choose a suitable clean mode according to the special situation, thereby carrying out the cleaning for the home room more fast, and improving user experience. The handle 4 is connected with the base 2 through a conduit 21, so that the user can carry the dust collector through the handle 4 to perform cleaning operation, which is more convenient, and furthermore, after the airflow with dust enters the base 2 through the floor brush assembly 3, the airflow firstly passes through the conduit 21 and then enters the dust collecting device 1 through the hose 5. It should be noted that, in the present embodiment, the floor brush assembly 3 is arranged above the base 2, and the floor brush assembly 3 is connected to the base 2. The dust collecting device 1 comprises a working component which can generate dust suction airflow, and in the present embodiment, the working component at least comprises an impeller and a motor for driving the impeller to rotate; the dust collecting device 1 at least comprises a first working state and a second working state, wherein when the dust collecting device is in the first working state, the dust collecting device 1 is mounted on the base 2, the floor brush assembly and the dust collecting device work together, and the dust suction airflow enters the base 2 from the floor brush assembly 3 and enters the dust collecting device 1 from the base 2, so that the user can quickly perform the cleaning operation through the floor brush assembly 3; when the dust collecting device 1 is in the second state, the dust collecting device 1 is separated from the base 2, and the dust suction airflow directly enters the dust collecting device 1, so that the user can take down the dust collecting device 1 from the base 2 as required and carry the dust collecting device 1 to perform the cleaning operation. It should be noted that, in other embodiments, the dust collecting device 1 further includes a third working state, and the handle is connected with a suction nozzle (not shown), wherein when the dust collecting device 1 is in the third working state, the user can perform the cleaning operation through the suction nozzle and the floor brush assembly 3 simultaneously, thereby improving the cleaning efficiency.

The dust collecting device 1 comprises a housing 11, the housing 11 defines a dust collecting chamber 111, the housing 11 further comprises a dust cover 112, the dust collecting device 1 further comprises a switch 12, and a user can directly take down the dust cover 112 through the switch 12 to open the dust collecting chamber 111. Specifically, the switch 12 is disposed on the dust cover 112, and the switch 12 includes a first connection end 121, correspondingly, the housing 11 is provided with a second connection end 113, and when the switch 12 is in a closed state, the first connection end 121 is clamped with the second connection end 113; when the user needs to take down the dust cover 112, the switch 12 can be lifted, at this time, the first connection end 121 and the second connection end 113 are separated from the clamping connection, the dust cover 112 is separated from the dust collecting device 1, and in the present embodiment, the first connection end 121 and the second connection end 113 are connected in a buckling manner. Further, the switch 12 further includes a first return member 122, and the first return member 122 is embodied as a spring in the present embodiment, and when the user removes the external force applied to the switch 12, the spring pushes the switch 12 to return to the original position. It should be noted that the user can lift the switch 12 to take down the dust cover 112 is only an embodiment, and in other embodiments, the first connection end 121 and the second connection end 113 are modified adaptively, so that the user can operate the switch 12 to take down the dust cover 112 by other manners, such as: pressing the switch 12 or rotating the switch 12, which will not be described in detail here.

The dust collector is provided with a dust collecting bag 14, dust collected during the work of the dust collector is stored in the dust collecting bag 14, and after the dust collecting bag 14 is filled with dust, the user can continuously perform the cleaning operation by replacing a new dust collecting bag. Specifically, the dust collecting bag 14 is disposed in the dust collecting chamber 111, in the present embodiment, the dust collecting bag 14 is mounted in the dust cover 112, the dust cover 112 is further provided with an operating member 13, and after the user take down the dust cover 112 from the dust collecting device 1, an external force can be applied to the operating member 13 to make the dust collecting bag 14 fall off, so that the user can take down the dust collecting bag 14 from the dust cover 112 without directly contacting the dust collecting bag 14, and the dust on the dust collecting bag 14 will not adhere to the user, thereby improving user experience. Further, the operating member 13 includes a first state and a second state, wherein when the operating member 13 is in the first state, the dust collecting bag 14 maintains be stably mounted on the dust cover 112; and when the operating member 13 is in the second state, the dust collecting bag 14 can be separated from the dust cover 112. It should be noted that the operating member 13 is not limited to only the first state and the second state, and when the operating member 13 is moved by an external force and is located between the position of the first state and the position of the second state, the operating member 13 is in the other state.

The dust collector further includes a supporting plate 15, the dust collecting bag 14 is mounted to the supporting plate 15, and the supporting plate 15 is detachably mounted to the dust cover 112. Specifically, the dust collecting bag 14 is attached to the supporting plate 15, and the dust collecting bag 14 and the supporting plate 15 are mounted on the dust cover 112 together. After the dust collecting bag 14 is filled with dust, the user can carry the dust collecting device 1 to a trash can, and the operating member 13 is operated to separate the supporting plate 15 from the dust cover 112, so that the supporting plate 15 and the dust collecting bag 14 fall into the trash can together, and thus, the user can continue the cleaning operation by only replacing a new supporting plate 15 attached with a dust collecting bag 14. It should be noted that the solution of dust collecting bag 14 being attached to the supporting plate 15 is only a preferred embodiment, and in other embodiments, the dust collecting bag 14 and the supporting plate 15 may be detachably connected, so that the user can only discard the dust collecting bag 14 and recycle the supporting plate 15.

The dust collector further comprises a bracket 16, the supporting plate 15 is detachably mounted on the bracket 16, the bracket 16 is accommodated in the dust collecting chamber 111, and the bracket 16 is mounted on the dust cover 112. When the operating member 13 is in the first state, the bracket 16 is connected to the operating member 13. Specifically, the bracket 16 includes a clamping portion 161, the operating member 13 includes an adapting portion 131, and when the operating member 13 is in the first state, the clamping portion 161 is connected to the adapting portion 131, in a preferred embodiment, the clamping portion 161 is configured as a hook portion, the adapting portion 131 is configured as a clamping slot, and when the operating member 13 is in the first state, the hook portion is clamped to the clamping slot, so that the operating member 13 is clamped to the bracket 16. It should be noted that in other embodiments, the connection mode between the operating member 13 and the bracket 16 can also be other clamping mode, not limited to the above connection mode.

The dust collector further comprises a rotating portion 17, the bracket 16 is connected with the rotating portion 17, the bracket 16 can rotate around the rotating portion 17 from a first position to a second position, and when the operating member 13 is in the first state, the bracket 16 is located in the first position. Specifically, after the user mounts the supporting plate 15 to the bracket 16, the supporting plate 15 can rotate around the rotating member 17 together with the bracket 16; the housing 11 further comprises a connecting member 114, when the bracket 16 is located at the first position, the supporting plate 15 mounted on the bracket 16 is connected to the connecting member 114, in a preferred embodiment, the user can rotate the bracket 16 along a first direction m to the first position, when the supporting plate 15 is connected to the connecting member 114, the operating member 13 is in the first state, and the clamping portion 161 is connected to the adapting portion 131; when the user applies an external force to the operating member 13 to make the operating member 13 in the second state, the clamping portion 161 is separated from the adapting portion 131, so that the supporting plate 15 and the bracket 16 move together around the rotating member 17 to the second position, and the supporting plate 15 is separated from the connecting member 114, and at this time, the supporting plate 15 is separated from the bracket 16 due to gravity; the user can separate the dust collecting bag 14 mounted to the supporting plate 15 together with the supporting plate 15 from the dust cover 112 without directly contacting the dust collecting bag 14 by simply operating the operating member 13. It should be noted that the second position is different from the first position, in the present embodiment, the second position may be level with the horizontal plane, and in other embodiments, the second position may also be selected according to the structural design of the dust collector.

Furthermore, the rotating member 17 includes a first shaft body 171 and a second shaft body 172, the bracket 16 is disposed between the first shaft body 171 and the second shaft body 172, and the bracket 16 is connected to the first shaft body 171 and the second shaft body 172, respectively, and specifically, the bracket 16 includes a first conduit 162 and a second conduit 163, the first conduit 162 is sleeved on the first shaft body 171, the second conduit 163 is sleeved on the second shaft body 172, thus, the bracket 16 is mounted on the shaft body 17, and the bracket 16 can rotate around the first shaft body 171 and the second shaft body 172 simultaneously, of course, it should be noted that, in other embodiments, it is also possible that the rotating member 17 is a conduit, and the supporting frame 16 includes a rotating shaft, the conduit of the rotating member 17 is sleeved on the rotating shaft of the bracket 16, so that the bracket 16 can also rotate around the rotating member 17. The dust collector comprises at least one elastic member 18, wherein the at least one elastic member 18 is arranged between the rotating member 17 and the bracket 16, one end of the elastic member 18 is connected with the housing 11, and the other end of the elastic member 18 is connected with the bracket 16. In a preferred embodiment, two elastic members 18 are provided in the housing 11, the elastic members 18 are torsion springs, and the two elastic members 18 are respectively sleeved on the first shaft body 171 and the second shaft body 172, so that the user pushes the bracket 16 along the first direction m to rotate the bracket 16 around the rotating member 17, when the bracket 16 rotates to the first position, the clamping portion 161 is clamped with the adapting portion 131, and at this time, the operating member 13 is in the first state, the elastic members 18 are in a twisted state, and the bracket 16 has a tendency of moving to the second position; when the operating member 13 is in the second state, the clamping portion 161 is separated from the adapting portion 131, and the elastic members 18 urge the bracket 16 and the supporting plate 15 to move together to the second position. It should be noted that the rotating member 17 including the first shaft body 171 and the second shaft body 172 is only an embodiment, in other embodiments, the rotating member 17 may also be a whole, the bracket 16 is sleeved on the rotating member 17, the elastic member 18 is disposed between the bracket 16 and the rotating member 17, one end of the elastic member 18 is connected to the bracket 16, and the other end is connected to the rotating member 17, so that when the bracket 16 rotates around the rotating member 17, the elastic member 18 may also be in a twisted state, and the bracket 16 tends to move to the second position. It should be noted that the elastic member 18 only needs to keep one end connected to the bracket 16, and the other end of the elastic member may be connected to the rotating member 17, or may be connected to the housing 11, or may be connected to other fixed structure disposed in the housing 11. Meanwhile, the first position is specifically a position where the bracket 16 is substantially perpendicular to the ground in the present embodiment, and of course, it should be noted that, in other embodiments, the first position may be set according to the needs of the user.

Furthermore, the bracket 16 further includes a limiting portion, and the supporting plate 15 can be matched with the limiting portion to be detachably mounted on the bracket 16. Specifically, the limiting portion is specifically a sliding slot 164 (164') in the present embodiment, the supporting plate 15 is movable along the sliding slot 164 (164'), and the supporting plate 15 includes an opening portion 151, and the opening portion 151 is connectable with the connecting member 114. The bracket 16 is provided with two corresponding sliding slots 164 (164'), through which the user can mount the supporting plate 15 on the bracket 16, and then the user can push the bracket 16 to rotate along the first direction m; when the supporting plate 15 moves along the sliding slot 164 (164') to a first predetermined position and the bracket 16 is located at the first position, the opening portion 151 is connected to the connecting member 114, thus when the operating member 13 is in the first state, the connecting member 114 can cooperate with the supporting plate 15 to prevent the supporting plate 15 from moving downward, so that the supporting plate 15 and the dust collecting bag 14 are stably mounted on the dust cover 112; when the operating member 13 is in the second state, the bracket 16 moves together with the supporting plate 15 to the second position, thus the opening 151 is separated from the connecting member 114, so that the supporting plate 15 moves downward along the slide groove 164 (164') by gravity until it is separated from the bracket 16. In the present embodiment, the connecting member 114 is fixedly disposed in the dust collecting chamber 111, and the connecting member 114 includes a protruding portion, so that the opening 151 can be clamped with the protruding portion. Meanwhile, the first predetermined position is related to the specific position of the connecting member 114 and the first position of the bracket 16, so that when the bracket 16 rotates to the first position, the opening 151 is connected to the connecting member 114. It should be noted that, it is only a preferred embodiment that the limiting portion is specifically a sliding slot, in other embodiments, the limiting portion may also include only a baffle, the supporting plate 15 may be attached to the baffle, and after the supporting plate 15 is separated from the connecting member 114, the supporting plate 15 is directly separated from the limiting portion due to gravity without moving along the sliding slot.

The operating member 13 is partially disposed in the dust collecting chamber 111 to be connected to the clamping portion 161, and partially disposed outside the dust collecting chamber 111 for operation by a user. Specifically, the operating member 13 includes a pressing portion 132 and a second return member 133, the pressing portion 132 is partially disposed outside the dust collecting chamber 111 for operation by a user, and the adapting portion 131 is at least partially disposed inside the dust collecting chamber 111 for connection with the clamping portion 161. The user can press the pressing portion 132 to move the operating member 13, so that the adapting portion 131 is separated from the clamping portion 161; the second return member 133 is specifically configured as a spring, when the user presses the pressing portion 132, the second return member 133 is compressed, and when the user removes the external force applied to the pressing portion 132, the second return member 133 pushes the operating member 13 to return the original position. It should be noted that, the unlocking of the dust collecting bag 14 by pressing the pressing portion 132 by the user is only one embodiment, and in other embodiments, the clamping portion 161 and the adapting portion 131 are adaptively modified, then the user can rotate the operating member 13 or lift the operating member 13 to unlock the dust collecting bag 14, and related contents are not described again.

It should be understood that although the specification describes embodiments, not every embodiment includes only a single embodiment, and such description is for clarity purposes only, those skilled in the art should take the specification as a whole, and the technical solution in each embodiment may be appropriately combined to form other embodiments which can be understood by those skilled in the art. The above list of detailed descriptions is only for the specific description of the feasible embodiments of the present disclosure, and they are not intended to limit the scope of the present disclosure, and all equivalent embodiments or modifications that do not depart from the technical spirit of the present disclosure should be included within the scope of the present disclosure.

The invention claimed is:

1. A dust collector with a dust collecting bag, the dust collector comprising:

a housing defining a dust collecting chamber;

a bracket accommodated in the dust collecting chamber;

an operating member connectable with the bracket;

a supporting plate, the dust collecting bag being mounted to the supporting plate;

a rotating member, the bracket being rotatable around the rotating member from a first position to a second position;

wherein the housing further includes a connecting member, and the operating member includes a first state and a second state;

when the operating member is in the first state, the bracket is located at the first position, and the supporting plate mounted on the bracket is connected with the connecting member; and when the operating member is in the second state, the bracket drives the supporting plate to move towards the second position so that the supporting plate is separated from the connecting member, and the supporting plate is separated from the bracket.

2. The dust collector of claim 1, wherein the rotating member includes a first shaft body and a second shaft body, the bracket is disposed between the first shaft body and the second shaft body, and the bracket is connected to the first shaft body and the second shaft body, respectively.

3. The dust collector of claim 1, wherein the dust collector further includes at least one elastic member, the at least one elastic member being arranged between the rotating member and the bracket, one end of the elastic member being connected with the housing, and the other end of the elastic member being connected with the bracket.

4. The dust collector of claim 1, wherein the bracket further includes a limiting portion, and the supporting plate is matched with the limiting portion to be detachably mounted on the bracket.

5. The dust collector of claim 4, wherein the limiting portion defines a sliding slot, and the supporting plate can move along the sliding slot.

6. The dust collector of claim 5, wherein the supporting plate includes an opening portion, and when the supporting plate moves to a first preset position along the sliding slot and the bracket is located at the first position, the opening portion is connected with the connecting member.

7. The dust collector of claim 6, wherein the connecting member is fixedly arranged in the dust collecting chamber and includes a protruding portion, and when the operating member is in the second state, the bracket drives the supporting plate to move towards the second position, so that the opening portion is separated from the protruding portion, and the supporting plate moves along the sliding slot due to gravity and is separated from the bracket.

8. The dust collector of claim 1, wherein the bracket further includes a clamping portion, and the operating member further includes an adapting portion, the clamping portion being connected with the adapting portion through a buckle when the operating member is in the first state, and the clamping portion being separated from the adapting portion when the operating member is in the second state.

9. The dust collector of claim 8, wherein the clamping portion includes a hook portion, the adapting portion defines a clamping slot, and when the operating member is in the first state, the hook portion is clamped in the clamping slot.

10. A dust collector with a dust collecting bag, the dust collector comprising:

a base;

a floor brush assembly located below the base and connected with the base;

a dust collecting device detachably mounted on the base and having a first working state and a second working state;

when the dust collecting device is in the first working state, the dust collecting device is mounted on the base, and the floor brush assembly and the dust collecting device work together;

when the dust collecting device is in the second working state, the dust collecting device is separated from the base; and the dust collecting device further including an operating member, the dust collecting bag being separable from the dust collecting device via movement of the operating member.

* * * * *